US009007271B2

(12) United States Patent
Harscher et al.

(10) Patent No.: US 9,007,271 B2
(45) Date of Patent: Apr. 14, 2015

(54) FOLDABLE LOG-PERIODIC ANTENNA

(75) Inventors: Marc Harscher, Laichingen (DE); Herbert Heidrich, Ichenhausen (DE); Joerg Logemann, Laichingen (DE)

(73) Assignee: EADS Deutschland GmbH, Ottobrunn (DE)

( * ) Notice: Subject to any disclaimer, the term of this patent is extended or adjusted under 35 U.S.C. 154(b) by 277 days.

(21) Appl. No.: 13/382,737

(22) PCT Filed: Jun. 24, 2010

(86) PCT No.: PCT/DE2010/000748

§ 371 (c)(1),
(2), (4) Date: Feb. 7, 2012

(87) PCT Pub. No.: WO2011/003389

PCT Pub. Date: Jan. 13, 2011

(65) Prior Publication Data

US 2012/0133566 A1 May 31, 2012

(30) Foreign Application Priority Data

Jul. 8, 2009 (DE) ..... 10 2009 032 107

(51) Int. Cl.
*H01Q 11/10* (2006.01)
*H01Q 1/08* (2006.01)

(52) U.S. Cl.
CPC ..... *H01Q 11/10* (2013.01); *H01Q 1/081* (2013.01)

(58) Field of Classification Search
CPC ..... H01Q 15/161; H01Q 1/08; H01Q 1/084; H01Q 1/1235
USPC ..... 343/880–882, 792.5
See application file for complete search history.

(56) References Cited

U.S. PATENT DOCUMENTS 3,176,302 A 3/1965 Tipton
3,715,759 A * 2/1973 Esposito et al. ..... 343/792.5
3,715,795 A 2/1973 Greenberg et al.

(Continued)

FOREIGN PATENT DOCUMENTS

DE 290260 6/1919
DE 33 06 054 A1 8/1984

(Continued)

OTHER PUBLICATIONS

International Search Report including English language translation dated May 11, 2010 (Six (6) pages).

*Primary Examiner* — Dameon E Levi
*Assistant Examiner* — Hasan Islam
(74) *Attorney, Agent, or Firm* — Crowell & Moring

(57) ABSTRACT

A foldable log-periodic antenna includes a feed line, one or more transmitting elements for transmitting and/or receiving electromagnetic signals, one or more supporting elements for holding the transmitting elements, and one or more elements for producing a tensile stress on the transmitting elements. One of the a transmitting elements is connected to one of the supporting elements and to the feed line, and with one supporting element is connected to the feed line via an articulated joint apparatus, such that the antenna can be moved from a transport position to an operating position and vice versa. The one or more elements for producing a tensile stress on the transmitting elements is a flexible tube, and can have an internal pressure applied to them and are connected to the supporting elements for holding the transmitting elements.

20 Claims, 3 Drawing Sheets

(56) References Cited

U.S. PATENT DOCUMENTS

Figure 1:
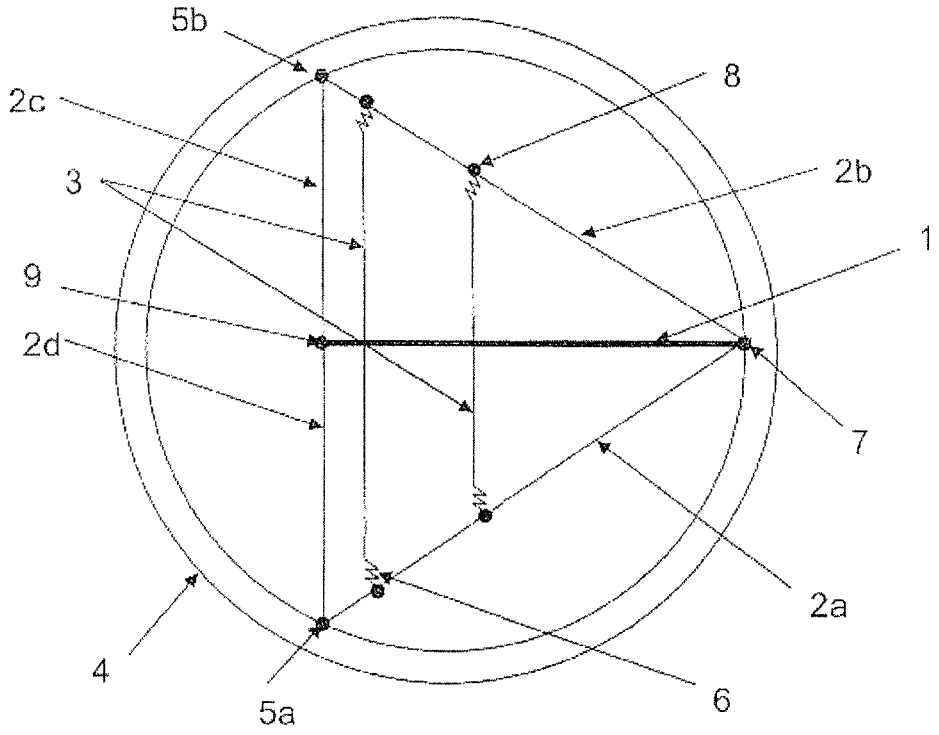

| | | | | |
|---|---|---|---|---|
| 4,262,293 | A | 4/1981 | Parmer | |
| 4,460,895 | A | 7/1984 | Bert et al. | |
| 4,564,844 | A | 1/1986 | Bowering | |
| 5,886,672 | A * | 3/1999 | Brune et al. | 343/792.5 |
| 5,945,962 | A * | 8/1999 | Harrington et al. | 343/792.5 |
| 6,353,419 | B1 * | 3/2002 | Gates et al. | 343/882 |
| 7,764,236 | B2 * | 7/2010 | Hill et al. | 343/702 |
| 2002/0093460 | A1 | 7/2002 | Alexeff et al. | |

FOREIGN PATENT DOCUMENTS

| | | | |
|---|---|---|---|
| EP | 1 923 955 | A1 | 5/2008 |
| FR | 2 908 930 | A1 | 5/2008 |
| GB | 495019 | | 11/1938 |

* cited by examiner

FOLDABLE LOG-PERIODIC ANTENNA

CROSS-REFERENCE TO RELATED APPLICATIONS

The present application claims priority under 35 U.S.C. §119 to German Patent Application No. 10 2009 032 107.1, filed Jul. 8, 2009, the entire disclosure of which is herein expressly incorporated by reference.

BACKGROUND AND SUMMARY OF THE INVENTION

Exemplary embodiments of the present invention relates to a foldable log-periodic antenna.

A log-periodic antenna (abbreviation LPDA for log-periodic dipole antenna, also referred to for short as a LogPed or LogPer) is a broadband antenna consisting of a number of dipoles, whose length and separation decrease toward the emission direction. The design of an LPDA is fundamentally known, for example from European Patent Document EP 1 923 955 A1.

LPDAs are used, inter alia, as television receiving antennas, in particular in this case DVB-T, since they can equally operate both in the very high frequency range (VHF) and in the ultrahigh frequency range (UHF), thus allowing a plurality of different frequency ranges or channels to be received by a single antenna. Wide frequency ranges can likewise be transmitted and received by LPDAs for EMC measurement technology. Further fields of use are military and civil radio communication, as well as detection vehicles for locating radio interference.

A further field of application of LPDAs is use as jamming transmitters, so-called jammers. In this case, the jamming transmitter transmits energy in the form of electromagnetic waves in an equivalent form to the transmitter to be jammed, in order to superimpose these waves on the original waves from the enemy transmitter, and thus to jam reception by the receiver.

Operationally, the use of a jammer requires a rapid setting-up and removal time. This requires that the LPDA must also be set up and removed again within a short time, that is to say it must be possible to move the LPDA from a transport position to an operating position and vice versa.

Exemplary embodiments of the present invention provide a foldable log-periodic antenna that can be moved from a transport position to an operating position and vice versa.

The log-periodic antenna according to the invention comprises a feed line, one or more transmitting means for transmitting and/or receiving electromagnetic signals, one or more supporting elements for holding the transmitting means, one or more means for producing a tensile stress on the transmitting means. The transmitting means are in this case connected to one of the supporting elements and to the feed line. One supporting element is in turn connected to the feed line via an articulated joint apparatus, such that the antenna can be moved from a transport position to an operating position and vice versa. According to the invention, the one or more means for producing a tensile stress on the transmitting means are in the form of a flexible tube, and can have an internal pressure applied to them. Furthermore, these one or more means for producing a tensile stress on the transmitting means are connected to the supporting elements for holding the transmitting means.

If an internal pressure is applied to the means, which are in the form of a flexible tube, for producing a tensile stress on the transmitting means, for example an internal pressure of up to 50 bar, then they attempt to assume the best energy state. The LPDA is then in the operating state in this best energy state. If the internal pressure is reduced, for example when the antenna is removed, then this best energy state no longer exists, and the antenna can be moved to a transport position.

Since the supporting elements are connected to the means, which are in the form of a flexible tube, for producing a tensile stress on the transmitting means, the antenna is virtually automatically moved from a transport position to an operating position when pressure is applied to the means which are in the form of a flexible tube.

Internal pressure is applied to the means in the form of a flexible tube by options that are known by a person skilled in the art, for example using pneumatic oils or compressed air. The means which are in the form of a flexible tube may, for example, be manufactured from PU flexible tubing or some other flexible and pressure-resistant material which is known by a person skilled in the art.

In a first embodiment of the invention, the transmitting means are in the form of stiff transmitting elements or flexible transmitting braids. Furthermore, the transmitting means are expediently manufactured from a corrosion-resistant conductive material, for example stainless steel.

In a second embodiment of the invention, the supporting elements for holding the transmitting means are in the form of stiff or flexible supporting elements. Expediently, the supporting elements are manufactured from a nonconductive material, for example glass fiber-reinforced plastics.

In a third embodiment of the invention, one or more additional means for producing a tensile stress on the transmitting means, for example one or more spring elements, is or are provided between the supporting element and the transmitting means, and/or between the feed line and the transmitting means. This ensures that a uniform tensile stress acts on the transmitting means despite changes in the length of the transmitting means caused, for example, by temperature fluctuations.

BRIEF DESCRIPTION OF THE DRAWING FIGURES

Figure 2:
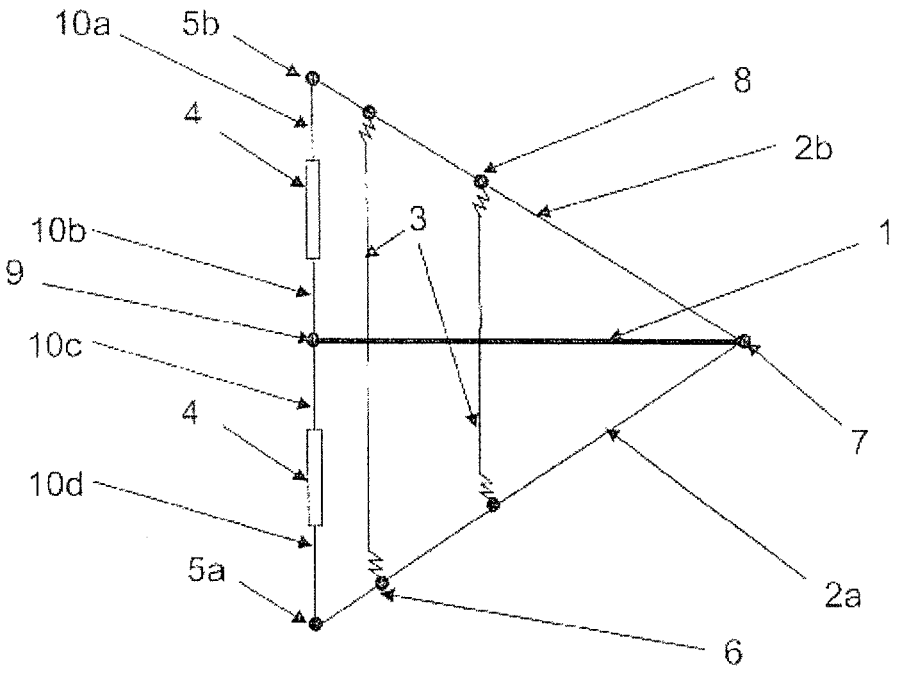
Figure 3:
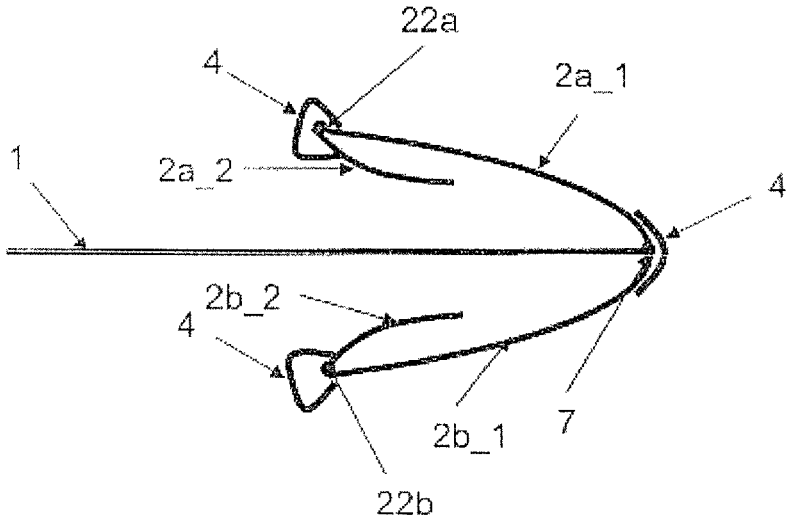
Figure 3:
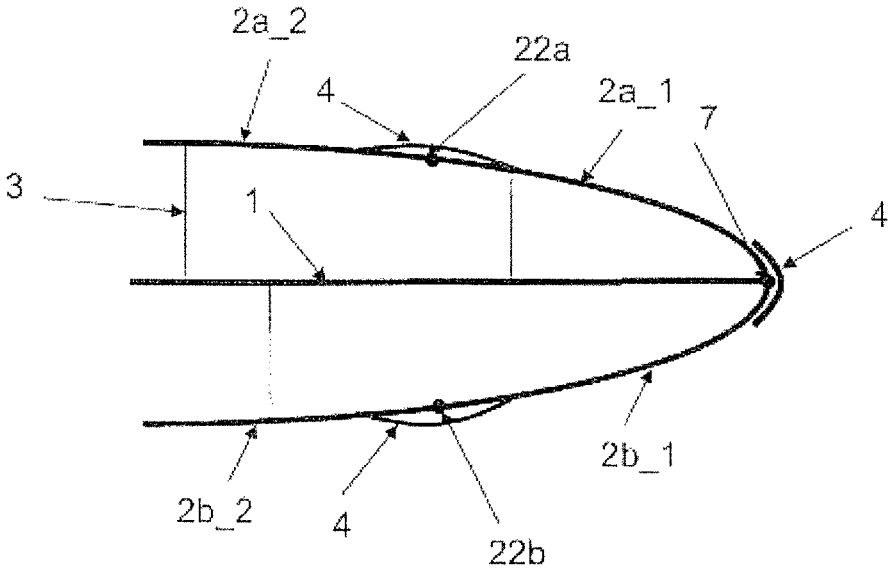

The invention will be explained in more detail in the following text with reference to drawings, in which:

FIG. 1 shows a first exemplary embodiment of a foldable LPDA according to the invention, FIG. 2 shows a second exemplary embodiment of a foldable LPDA according to the invention, FIG. 3 shows a third exemplary embodiment of a foldable LPDA according to the invention.

DETAILED DESCRIPTION

FIG. 1 shows a first exemplary embodiment of a foldable LPDA according to the invention in the operating state.

In this antenna design, the feed line 1 is connected at one end via the connecting point 7 to the supporting elements 2*a*, 2*b*. Transmitting means 3 are arranged between the feed line 1 and the supporting elements 2*a*, 2*b*.

The means 4 for producing a tensile stress on the transmitting means is annular in this design. In the operating state, that is to say when pressure is applied to the means 4, the means 4 assumes the best energy state, which in this case corresponds to the shape of a ring.

The support element 2*a* is connected at the connecting points 5*a*, 7 to a means for producing a tensile stress on the transmitting means. The supporting element 2*b* is connected at the connecting points 5*b*, 7 to a means 4 for producing a tensile stress on the transmitting means. The two supporting elements 2*a*, 2*b* as well as the feed line 1 are thus connected at the connecting point 7 to the means 4 for producing a tensile stress on the transmitting means. This connecting point 7 furthermore acts as an articulated joint between the feed line 1 and the supporting elements 2*a*, 2*b*.

The supporting elements 2*a*, 2*b*, the feed line 1 and the transmitting means 3 may be either in the form of stiff elements or flexible wires. When flexible wires are used, it is possible to considerably reduce the packing size in the transport position. This variant also results in weight savings.

The supporting elements 2*a*, 2*b* are manufactured from nonconductive material, for example glass-fiber-reinforced plastics. The feed line 1, which is also referred to as a boom tube, is a two-wire line or a stripline. The transmitting means 3 are manufactured from a conductive and corrosion-resistant material, for example stainless steel. The coupling of the transmitting means 3 between the supporting elements 2*a*, 2*b* and the feed line 1 in order to achieve the emission characteristics desired when the antenna is in the operating position is carried out in accordance with rules which are known by a person skilled in the art, for example using the cruciform principle, that is to say a horizontal electrical connection with alternating association of the antenna elements (http://www-.wikiweise.de/wiki/Logarithmisch-Periodische%20Dipolantenne).

Guy apparatuses 2*c*, 2*d* are provided in order to additionally hold the feed line 1. These guy apparatuses 2*c*, 2*d* are each connected at one end via the connecting point 9 to the feed line 1 and at the other end via the connection point 5*a* or 5*b* to the means 4 for producing a tensile stress on the transmitting means. This ensures that the antenna has additional stability in the operating position.

The transmitting means 3 are connected via spring elements 6 to the supporting elements 2*a*, 2*b*. This results in an additional tensile force being produced on the transmitting means 3 when the antenna is in the operating state. This additional tensile force compensates, for example, for changes in the length of the transmitting means 3 which are caused by temperature fluctuations in the surrounding area.

As already described above, the means 4 assumes the best energy state in the operating state. In this case, the supporting elements 2*a*, 2*b* are braced between the connecting points 5*b* and 7, as well as 5*a* and 7. In this position, the supporting elements 2*a*, 2*b* move the transmitting means 3, which are attached to them via the connecting point 8, to the optimum position for the operating state.

FIG. 2 shows a second embodiment of a foldable LPDA according to the invention. In this variant, the arrangement of the feed line 1, of the transmitting means 3, of the supporting elements 2*a*, 2*b* and of the spring elements 6 corresponds to that already described in FIG. 1.

A means 4 for producing a tensile stress on the transmitting means is in each case connected at the connecting point 9 to the feed line 1 and at the connecting point 5*a* or 5*b* to the respective supporting element 2*a* or 2*b*. The connection is made via connecting elements 10*a*, 10*b*, 10*c*, 10*d*, which are in the form of stiff elements.

When pressure is applied to the means 4, they assume the best energy state. In this case, the means 4 are designed such that the best energy state corresponds to a straight line. When moving from a transport position to an operating position, the connecting elements 10*a*, 10*b* and 10*c*, 10*d* are erected such that the transmitting means 3 are braced between the feed line 1 and the supporting elements 2*a*, 2*b*.

FIG. 3 shows a third embodiment of a foldable LPDA according to the invention. The LPDA is shown in a transport position in the upper part of FIG. 3, and in an operating position in the lower part of that figure.

The reference symbols used in FIG. 3 denote the same items as in FIG. 1 and FIG. 2.

In this embodiment, the supporting elements 2*a*, 2*b* are each divided into two subpieces 2*a*_1 and 2*a*_2, as well as 2*b*_1 and 2*b*_2. The respective subpieces of a supporting element 2*a*, 2*b* are connected via a respective articulated joint 22*a* or 22*b*. Furthermore, the supporting elements 2*a*, 2*b* are connected to a means 4 in the area of this articulated joint 22*a*, 22*b*. In this case, however, the means 4 is not connected to the articulated joint 22*a*, 22*b*.

The two supporting elements 2*a*, 2*b* are connected to one another and to the feed line 1 in the same way as in FIG. 1 and FIG. 2 at the connecting point 7, which acts as an articulated joint. In addition, the two supporting elements 2*a*, 2*b* are connected to one another in the area of the connecting point 7 via a means 4, where this means 4 is not connected to the articulated joint at the connecting point 7.

For clarity reasons, the transmitting means 3 between the supporting element 2*a*, 2*b* and the feed line are shown only in the lower part of the figure (operating position) in FIG. 3.

When pressure is applied to the means 4, then they assume the best energy state for them. In FIG. 3, this best energy state is virtually a straight line in the area of the articulated joints 22*a* and 22*b*. There is virtually a semicircle in the area of the connecting point 7. In the area of the articulated joints 22*a*, 22*b*, the stretching of the means 4 leads to the subpieces 2*a*_2 and 2*b*_2 folding over, and forming an extension of the subpieces 2*a*_1 and 2*b*_1.

Based on a similar principle, the feed line 1 can likewise be subdivided into one or more subpieces.

In the area of the connecting point 7, the application of pressure to the means 4 which is arranged there likewise leads to stretching, with the two supporting elements 2*a*, 2*b* being moved away from one another. This ensures that a tensile stress acts on the transmitting element 3 in the operating position.

As in FIG. 1 and FIG. 2, spring elements can, of course, additionally be arranged between the transmitting elements 3 and the supporting means 2*a*, 2*b*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A foldable log-periodic antenna comprising:

a feed line;

transmitting means for transmitting or receiving electromagnetic signals;

two supporting elements for holding the transmitting means;

means for producing a tensile stress on the transmitting means, wherein one of the transmitting means is connected to both of the two supporting elements via respective spring elements, and the one of the transmitting means is connected to the feed line, wherein one of the supporting elements is connected to the feed line via an articulated joint apparatus, such that the antenna is moveable from a transport position to an operating position and vice versa, wherein the means for producing a tensile stress on the transmitting means are a flexible tube, and can have an internal pressure applied to them and are connected to the supporting elements to hold the transmitting means, and wherein the two supporting elements, the feed line, and the flexible tube are connected to each other at a common connection point.

2. The foldable log-periodic antenna as claimed in claim 1, wherein the transmitting means are stiff transmitting elements or flexible transmitting braids.

3. The foldable log-periodic antenna as claimed in claim 2, wherein the transmitting means are comprised of a corrosion-resistant conductive material.

4. The foldable log-periodic antenna as claimed in claim 3, wherein the corrosion-resistant conductive material is stainless steel.

5. The foldable log-periodic antenna as claimed in claim 1, wherein the supporting elements are stiff or flexible supporting elements.

6. The foldable log-periodic antenna as claimed in claim 5, wherein the supporting elements for holding the transmitting means are comprised of a nonconductive material.

7. The foldable log-periodic antenna as claimed in claim 6, wherein the nonconductive material is glass-fiber-reinforced plastic.

8. The foldable log-periodic antenna as claimed in claim 1, further comprising:

additional means for producing a tensile stress on the transmitting means, the additional means is arranged between the supporting element and the transmitting means, or between the feed line and the transmitting means.

9. The foldable log-periodic antenna as claimed in claim 1, wherein the feed line is a two-wire line or a stripline.

10. The foldable log-periodic antenna as claimed in claim 1, wherein the supporting elements are stiff or flexible supporting elements.

11. The foldable log-periodic antenna as claimed in claim 10, wherein the supporting elements for holding the transmitting elements are comprised of a nonconductive material.

12. The foldable log-periodic antenna as claimed in claim 11, wherein the nonconductive material is glass-fiber-reinforced plastic.

13. The foldable log-periodic antenna as claimed in claim 1, wherein the transmitting means comprises a plurality of transmitting means and the flexible tube is a common flexible tube arranged to produce the tensile stress on the plurality of transmitting means.

14. A foldable log-periodic antenna comprising:

a feed line;

transmitting elements configured to transmit or receive electromagnetic signals;

two supporting elements configured to hold the transmitting elements;

elements configured to produce a tensile stress on the transmitting elements, wherein one of the transmitting elements is connected to both of the two supporting elements via respective spring elements, and the one of the transmitting elements is connected to the feed line, wherein one of the supporting elements is connected to the feed line via an articulated joint apparatus, such that the antenna is moveable from a transport position to an operating position and vice versa, wherein the elements configured to produce a tensile stress on the transmitting elements are a flexible tube, and can have an internal pressure applied to them and are connected to the supporting elements to hold the transmitting elements, and wherein the two supporting elements, the feed line, and the flexible tube are connected to each other at a common connection point.

15. The foldable log-periodic antenna as claimed in claim 14, wherein the transmitting elements are stiff transmitting elements or flexible transmitting braids.

16. The foldable log-periodic antenna as claimed in claim 15, wherein the transmitting elements are comprised of a corrosion-resistant conductive material.

17. The foldable log-periodic antenna as claimed in claim 16, wherein the corrosion-resistant conductive material is stainless steel.

18. The foldable log-periodic antenna as claimed in claim 14, further comprising:

additional elements configured to produce a tensile stress on the transmitting elements, the additional elements are arranged between the supporting element and the transmitting elements, or between the feed line and the transmitting elements.

19. The foldable log-periodic antenna as claimed in claim 14, wherein the feed line is a two-wire line or a stripline.

20. The foldable log-periodic antenna as claimed in claim 14, wherein the transmitting elements comprise a plurality of transmitting elements and the flexible tube is a common flexible tube arranged to produce the tensile stress on the plurality of transmitting elements.

* * * * *